United States Patent [19]

Yorioka

[11] 4,203,400

[45] May 20, 1980

[54] EXHAUST GAS RECIRCULATION SYSTEM FOR AN INTERNAL COMBUSTION ENGINE

[75] Inventor: Keigo Yorioka, Oobu, Japan

[73] Assignee: Aisan Industry Co., Ltd., Ohbu, Japan

[21] Appl. No.: 967,153

[22] Filed: Dec. 6, 1978

[30] Foreign Application Priority Data

Dec. 13, 1977 [JP] Japan ..... 52/149673

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 4,041,917 | 8/1977 | Suzuki | 123/119 A |
| 4,090,482 | 5/1978 | Yoshida | 123/119 A |
| 4,092,960 | 6/1978 | Nohira et al. | 123/119 A |
| 4,130,093 | 12/1978 | Aoyama | 123/119 A |
| 4,148,286 | 4/1979 | Kohama et al. | 123/119 A |
| 4,150,648 | 4/1979 | Ogita | 123/119 A |

*Primary Examiner*—Wendell E. Burns

*Attorney, Agent, or Firm*—Cushman, Darby & Cushman

[57] ABSTRACT

An exhaust gas recirculation system for an internal combustion engine wherein a fixed restriction, a pressure chamber and a pressure control valve are arranged in the order named in an exhaust gas recirculation passage and the pressure control valve is controlled in such a way that the pressure in the pressure chamber may be maintained equal to the combined pressure which is obtained by the comparison between two amplified pressure signals A and B both of which represent the quantity such as the negative pressure in an intake pipe which in turn represents the variations in load on the engine. With these two pressure signals A and B, the pressure in the pressure chamber may be varied from the exhaust gas pressure to the pressure a few times the negative pressure created in a venturi in the intake pipe, whereby in response to the variations in load on the engine, which may be represented by the variations in the negative pressure in the intake pipe, the ratio of the flow rate of the exhaust gases to be recirculated to the quantity of the intake air may be varied more widely than in the exhaust gas recirculation system.

10 Claims, 4 Drawing Figures

EXHAUST GAS RECIRCULATION SYSTEM FOR AN INTERNAL COMBUSTION ENGINE

BACKGROUND OF THE INVENTION

The present invention relates to an exhaust gas recirculation system for purifying the exhaust gases emitted from an internal combustion engine.

In any exhaust gas recirculation systems, it is a very important and critical problem how to determine the ratio of the flow rate of the exhaust gases to be recirculated to the quantity of intake air. (The above ratio will be referred to as "EGR ratio" for brevity hereinafter in this specification and the above flow rate, as "EGR quantity".) There has been devised and demonstrated a prior art exhaust gas recirculation system wherein in order to maintain EGR ratio constant all the time, a pressure chamber is provided in an exhaust gas recirculation passage in such a way that the pressure in the pressure chamber may be maintained nearly at the atmospheric pressure and the exhaust gases are forced into the pressure chamber through a restriction. This system is based upon the observed fact that the exhaust gas pressure is nearly square of the quantity of intake air. However, it has recently become well known to those skilled in the art that in order to improve the efficiency of the purification of exhaust gases as well as the riding quality, when the quantity of intake air remains constant, the higher the negative pressure in the intake pipe (to be referred to as "the negative intake pressure" for brevity in this specification), the smaller EGR ratio must be made. To this end, there has been devised and demonstrated and exhaust gas recirculation system wherein the opening of the restriction through which the exhaust gases are forced into the pressure chamber is varied in response to the negative intake pressure. More particularly, the variable restriction is controlled by a plunger which in turn is controlled in response to the negative intake pressure. However, this system gives rise to a problem of sealing the plunger, a problem of high fabrication cost and a problem of durableness of the variable restriction in the exhaust gases which are high in temperature and contain strong acids and carbon particles which cause rapid wear and abrasion of the variable restriction. Furthermore as the carbon particles deposit upon the variable restriction, its response to the variations in the negative intake pressure is varied, but so far there has not been proposed any successful method for correcting such variation.

A further problem of the prior art exhaust gas recirculation systems is that because of the high resistance to the flow of exhaust gases encountered in the exhaust gas recirculation passage, a satisfactory EGR quantity cannot be obtained with the exhaust gas pressure is weak. Furthermore, when the engine is decelerated so that the negative intake pressure is consideranbly increased, the exhaust gas recirculation cannot be interrupted.

In order to vary EGR ratio in response to the variations in load on engine, there have been devised and demonstrated various exhaust gas recirculation systems. In one system (I), a negative pressure created in a venturi in an intake pipe (to be referred to as "the venturi negative pressure" for brevity hereinafter in this specification) is amplified in response to the instant load on engine, and the pressure in the pressure chamber is maintained at a pressure nearly equal to the amplified venturi negative pressure. In another system (II), the pressure in the pressure chamber is maintained at a pressure nearly equal to a negative pressure at a port formed adjacent to the position where a throttle valve is completely closed. Both systems (I) and (II) have a common defect that the pressure in the pressure chamber cannot be made lower than the negative intake pressure. As a result, the system (I) cannot use a high amplification factor for the amplification of the venturi negative pressure in the case of a heavy load. In the system (II) the throttle valve is caused to open at heavy load so that the negative pressure at the port will not respond to the load on the engine. Thus it has been extremely difficult to maintain a high EGR ratio even at heavy loads while varying EGR ratio fully in response to the variations in load on the engine.

SUMMARY OF THE PRESENT INVENTION

The present invention was made to overcome the above and other problems encountered in the prior art exhaust gas recirculation systems.

The object of this invention is to provide an exhaust gas recirculation system wherein the EGR ratio may be varied more widely than in the prior art exhaust gas recirculation systems with the variation in engine load by making the pressure in the pressure chamber fluctuate more widely than in the said prior art systems.

The present invention provides an exhaust gas recirculation system for an internal combustion engine comprising exhaust gas recirculation means for recirculating the exhaust gases from an exhaust pipe to an intake pipe, said means including a fixed restriction, a pressure chamber and a pressure control valve means having a pressure control valve arranged in the order named; first amplification means for amplifying the venturi negative pressure in response to the quantity such as the negaive intake pressure representative of the variations in load on said engine; second amplification means for amplifying said venturi negative pressure in response to the quantity such as the negative intake pressure representative of the variations in load on said engine; comparator means for receiving the output pressures from said first and second amplification means and the pressure in said pressure chamber so as to produce the combined pressure of said output pressures which is in proportion to said venturi negative pressure and to compare said combined pressure with said pressure from said pressure chamber; and control means which cooperates with said comparator means so as to control said pressure control valve, thereby establishing the equilibrium between said combined pressure and said pressure in said pressure chamber.

DESCRIPTION OF THE PREFERRED EMBODIMENT

Figure 1:
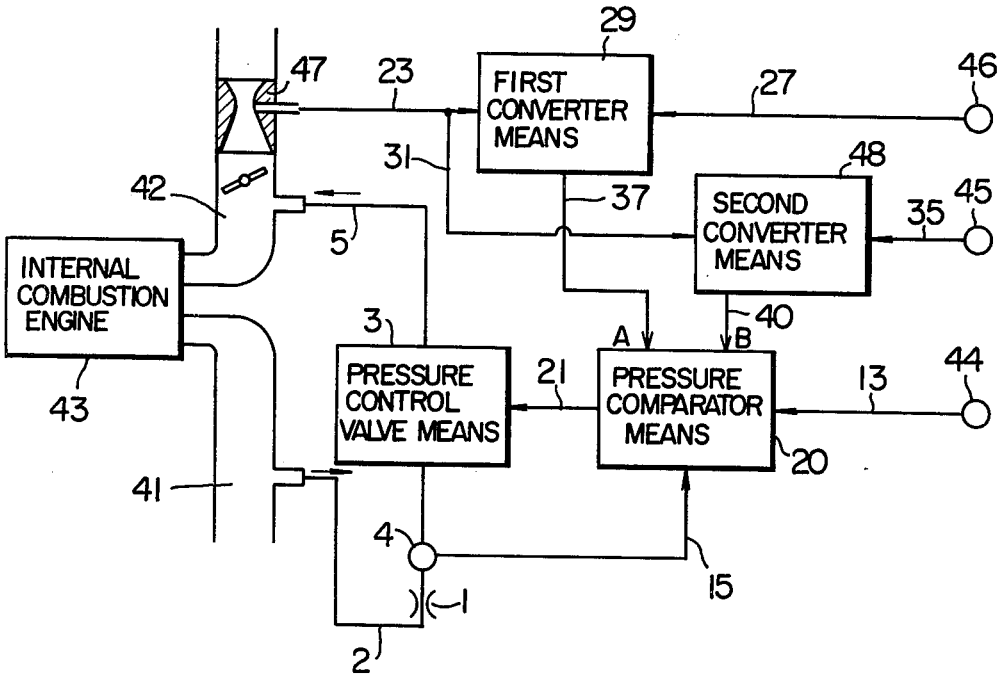
FIG. 1 is a block diagram of a preferred embodiment of an exhaust gas recirculation system in accordance with the present invention.

Referring to FIG. 1, part of the exhaust gases discharged from an internal combustion engine 43 through an exhaust pipe 41 is recirculated through an EGR pipe 2, a fixed restriction 1, a pressure chamber 4, a pressure control valve means 3 and an EGR pipe 5 into an intake pipe 42 including a venturi 47. The pressure control valve means 3 includes a pressure control valve and its actuating means such as a diaphragm as will be described in detail hereinafter.

The negative pressure created in the venturi 47 is transmitted through a transmission pipe 23 to a first converter means 29 to which is also transmitted the signal such as an negative intake pressure representative of the variations in engine load from a pressure source 46 through a transmission pipe 27. The first converter means 29 converts the venturi negative pressure into the pressure signal A in response to the magnitude of the negative intake pressure. The pressure signal A, which represents the variations in engine load, is transmitted through a pressure signal transmission pipe 37 to a pressure comparator means 20.

The negative pressure created in the venturi 47 is also transmitted through a branched line 31 to a second converter means 48 to which is also transmitted the signal such as negative intake pressure representative of the variations in engine load from a pressure source 45 through a transmission pipe 35. The second converter means 48 converts the venturi negative pressure into the pressure signal B in response to the negative intake pressure. The pressure signal B, which represents the variations in engine load, is transmitted through a pressure signal transmission pipe 40 to the pressure comparator means 20. The comparator means 20 combines the pressure signals A and B and compares the combined pressure signal with the pressure in the pressure chamber 4 which is transmitted through a transmission line 15 to the comparator means 20. In response to the pressure difference signal thus obtained, the comparator means 20 controls the working fluid flowing from a pressure source 44 through lines 13 and 21 to the pressure control valve 3. The working fluid may be the negative intake pressure or the air supplied from the pressure source 44 which may be an air pump.

Figure 2:
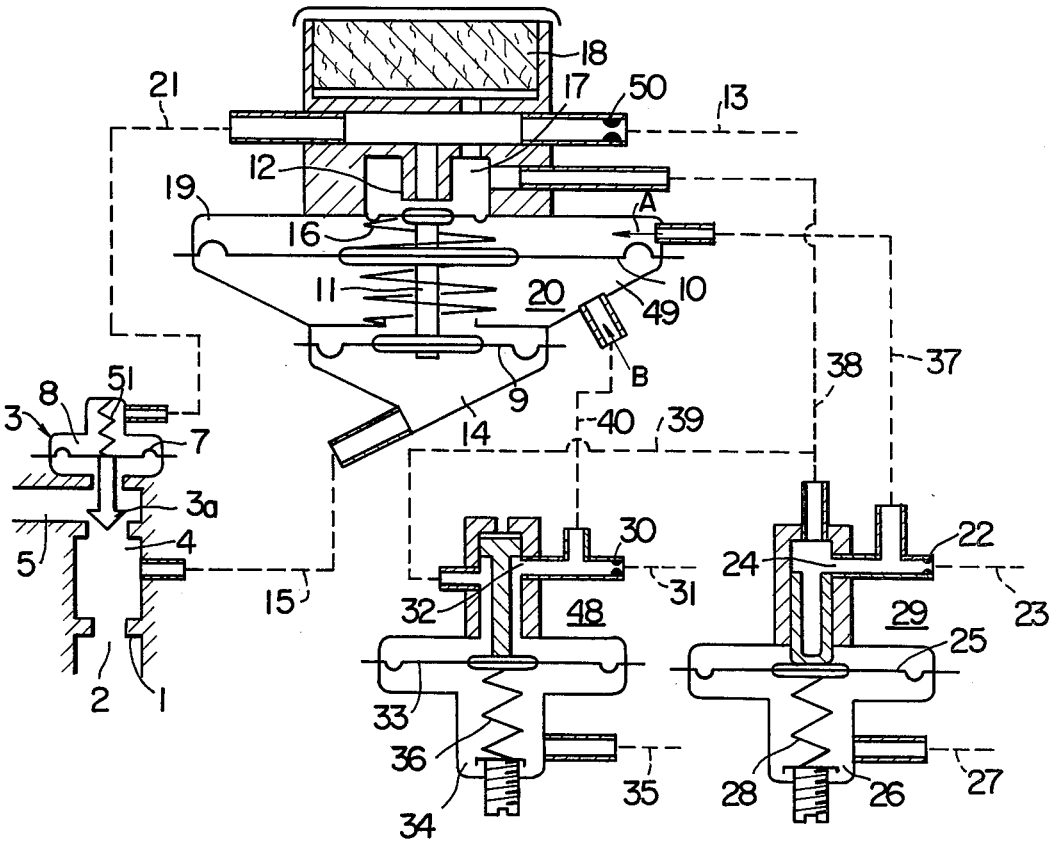
FIG. 2 is a detailed view illustrating major components thereof.

Next referring particularly to FIG. 2, the preferred embodiment of the present invention will be described in more detail below. In the preferred embodiment the pressure control valve means includes a diaphragm operated valve 3a with a diaphragm 7 which is an actuating means. When the negative pressure in a diaphragm chamber 8 increases, the diaphragm 7 is caused to deflect itself upwards against a spring 51 so that the degree of opening of the control valve 3a is increased accordingly.

The first converter means 29 is provided with a variable restriction 24 operatively connected to a diaphragm 25. When the negative intake pressure is increased, the diaphragm 25 is caused to be deflected downwards against a spring 28 so that the variable restriction 24 increases the passage between the negative pressure transmission line 23 from the venturi 47 and a pressure transmission line 38 leading to an atmospheric pressure chamber 17. The venturi negative pressure transmission line 23 is also connected through a fixed restriction 22 and the pressure signal line 37 to a diaphragm chamber 19 of the comparator means 20.

The second converter means 48 is similar in construction to the first converter means 29. It is also provided with a variable restriction 32 and a fixed restriction 30. The variable restriction 32 is operatively coupled to a diaphragm 33. When the negative intake pressure increases, the diaphragm 33 is caused to be deflected downwards against a spring 36 so that the variable restriction 32 decreases the degree of its opening. One port of the variable restriction 32 is communicated through the fixed restriction 30 and the branched line 31 and the venturi negative pressure transmission pipe 23 with the venturi 47 and with a lower diaphragm chamber 49 through the pressure signal transmission line 40. To other port of the variable restriction 32 is communicated through a pressure transmission line 39 connected to the pressure transmission line 38 to the atmospheric pressure chamber 17 of the comparator means 20.

The pressure comparator means 20 includes a rod 11 and lower and upper diagragms 9 and 10 both connected to the rod 11. The pressure signal A is transmitted from the first converter means 29 through the pressure signal transmission line 37 to the upper diaphragm chamber 19 above the upper diaphragm 10. The pressure in the pressure chamber 4 is transmitted through the pressure transmission line 15 to a lower diaphragm chamber 14 below the lower diaphragm 9. The pressure signal B is transmitted from the second converter means 48 through the pressure signal transmission line 40 into the intermediate diaphragm chamber 49 defined between the lower and upper diaphragms 9 and 10.

The upper end of the rod 11 serves as a valve head of a pilot valve 12. One port of the pilot valve 12 is communicated with the atmospheric pressure chamber 17 while the other port thereof is communicated with the working fluid transmission line 21 leading to the pressure control valve means 3 and with the working fluid transmission line 13 through a fixed restriction 50. The atmospheric pressure chamber 17 is communicated through an air cleaner 18 with the surrounding atmosphere. A diaphragm 16 separates the atmospheric pressure chamber 17 from the upper diaphragm chamber 19 and has its center securely fixed to the rod 11. The area of the diaphragm 16 is considerably smaller than those of the lower and upper diaphragm 9 and 10.

It is to be understood that the first and second converter means 29 and 48 may be combined in such a way that both the variable restrictions 24 and 32 may be actuated by the displacement of a single diaphragm instead of two diaphragms 25 and 33.

The ratio $\alpha$ between the pressure in the upper diaphragm chamber 19 and the venturi negative pressure varies between 0 and 1. That is, when the negative intake pressure is sufficiently high, the variable restriction 24 is widely opened so that the pressure in the upper diaphragm chamber 19 equals the atmospheric pressure. Hence, the ratio $\alpha$ becomes zero. On the other hand, when the negative intake pressure is sufficiently low, the variable restriction 24 is completely closed so that the pressure in the upper diaphragm chamber 19 equals the venturi negative pressure. Hence the ratio a becomes 1.

In like manner, the ratio $\beta$ between the pressure in the intermediate diaphragm chamber 49 and the venturi negative pressure varies between 1 and 0. That is, when the negative intake pressure is sufficiently high, the variable restriction 32 is completely closed so that the pressure in the intermediate diaphragm chamber 49 becomes equal to the venturi negative pressure. Hence the ratio $\beta$ is 1. On the other hand when the negative intake pressure is sufficiently low, the variable restriction 32 is widely opened so that the pressure in the intermediate diaphragm chamber 49 becomes equal to the atmospheric pressure. Hence the ratio $\beta$ is 0.

With the constant negative intake pressure, the degree of opening provided by the variable restriction 24 is constant. Therefore it follows that the ratio $\alpha$ remains at a constant value which is dependent upon both the degrees of opening or resistance provided by the variable and fixed restrictions 24 and 22. Furthermore, the degree of opening provided by the variable restriction 32 is constant. Therefore the ratio $\beta$ remains at a constant value which is dependent upon the degrees of opening or resistance of both the variable and fixed restrictions 32 and 30. These ratios $\alpha$ and $\beta$ may be suitably selected by selecting the suitable characteristics of the variable restrictions 24 and 32 which in turn are dependent upon the configurations of slits.

It is assumed that when part of the exhaust gases is recirculated from the exhaust pipe 41 through the EGR pipe 2, the fixed restriction 1, the pressure chamber 4, the pressure control valve means 3 and the EGR pipe 5 into the intake pipe 42, the pressure in the pressure chamber 4 is in equilibrium at an absolute pressure P. When the pressure P is increased to $P+\Delta P$ due to a disturbance, this pressure increase is transmitted through the pressure transmission line 15 into the lower diaphragm chamber 14 so that the lower diaphragm 9 is deflected upwards and consequently the rod 11 is lifted. As a consequence, the pilot valve 12 is closed with the upper end of the rod 11 cutting off the communication between the atmospheric pressure chamber 17 the working fluid transmission lines 13 and 21. Then the negative pressure transmitted to the diaphragm chamber 8 of the pressure control valve means 3 through the transmission lines 13 and 21 is increased so that the diaphragm 7 is deflected upwards and consequently the pressure control valve 3a is lifted with the resultant increase in degree of opening thereof. Thus the pressure in the pressure chamber 4 is automatically restored to its initial or equilibrium pressure P. More specifically, the pressure control valve 3a, the diaphragm 7 for actuating the former, the pressure comparator means 20 and the pilot valve 12 constitute an automatic control system which is satisfactorily actuated with the power supplied from the working fluid which in turn is supplied from the pressure source 44. As a result, the pressure in the pressure chamber 4 may be practically isolated from any disturbances and may be maintained substantially at a constant level. More particularly, the pressure within the pressure chamber 4 is in proportion to A−B where A=(the ratio $\alpha$, which corresponds to the negative intake pressure)×(the area of the upper diaphragm 10)×(the venturi negative pressure), and B=(the ratio $\beta$, which corresponds to the negative intake pressure)×(the area of the diaphragm 10−the area of the diaphragm 9)×(the venturi negaive pressure).

Otherwise expressed, (the pressure in the chamber 4)×(the area of the diaphragm 9)=(the area of the diaphragm 10)×(the pressure in the upper diaphragm chamber 19)−(the area of the lower diaphragm 10)×(the pressure in the intermediate diaphragm chamber 49)+(the area of the diaphragm 9)×(the pressure in the chamber 49)=A−B.

It should be noted that the pressure in the pressure chamber 4 is proportional to the venturi negative pressure so that when the negative intake pressure is constant, the EGR ratio is also constant.

Next the response to the variations in negative intake pressure will be investigated. In response to the variations in the negative intake pressure, the pressure in the pressure chamber 4 varies so that EGR ratio also varies with negative intake pressure. Assume that the absolute value of the venturi negaive pressure be equal to the exhaust gas pressure, that the ratio of the area of the diaphragm 10 to that of the diaphragm 9 be 2 and that the presence of the diaphragm 16 may be negligible in its effect upon the overall response of the system. Then, in terms of the ratios $\alpha$ and $\beta$, the ratio of the pressure in the pressure chamber 4 to the venturi negaive pressure becomes $$\text{pressure in chamber 4/venturi negative pressure} = 2\alpha - \beta \quad (1)$$

As described elsewhere, when the negative intake pressure is sufficiently high, $\alpha=0$ and $\beta=1$. Substituting these values into Eq. (1), we have $$\text{pressure in chamber 4/venturi pressure} = -1$$

This means that the pressure in the pressure chamber 4 equals the exhaust gas pressure. The pressure difference across the fixed restriction 1 becomes zero so that the EGR quantity becomes zero and consequently EGR ratio becomes also zero.

When the negative intake pressure is sufficiently low, $\alpha=1$ and $\beta=0$. Substituting these values in Eq. (1), we have $$\text{pressure in chamber 4/venturi negative pressure} = 2$$

This means that the pressure difference across the fixed restriction 1 equals three times the exhaust gas pressure.

In the prior art exhaust gas pressure responsive exhaust gas recirculation systems, the pressure in the pressure chamber 4 is normally maintained at the atmospheric pressure so that the pressure difference across the fixed restriction 1 is normally equal to the exhaust gas pressure. However, according to the present invention, the pressure in the pressure chamber 4 fluctuates between the exhaust gas pressure and the pressure twice the venturi negative pressure so that EGR ratio may be varied from 0 to about 1.7 times EGR ratio attainable with the prior art EGR systems.

Figure 3A:
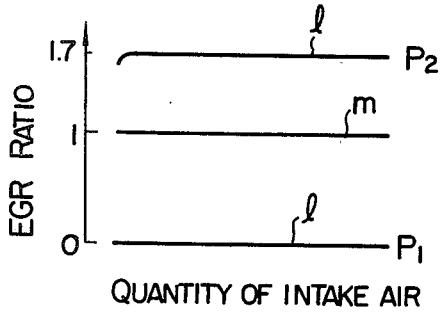
FIG. 3*a* is a graph showing the characteristic curves l of the exhaust gas recirculation system of the present invention and that m of a prior art system for the sake of comparison, the quantity of intake air being plotted along the abscissa while EGR ratio, along the ordinate.
Figure 3B:
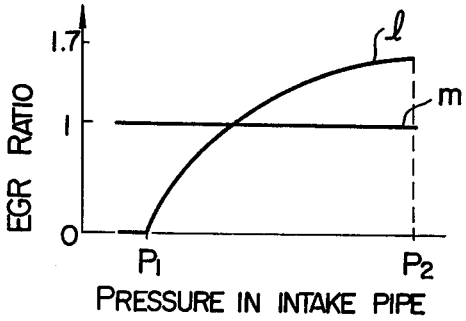
FIG. 3*b* is a graph showing the characteristic curve 1 of the system of the present invention and that m of the prior art system for the sake of comparison, the negative intake pressure being plotted along the abscissa while EGR ratio, along the ordinate.

FIGS. 3a and 3b show the comparisons between the characteristics l and m of the EGR systems of the present invention and the prior art. In these Figures $\alpha=0$ and $\beta=1$ when the negative intake pressure is $P_1$ and $\alpha=1$ and $\beta=0$ when the negative intake pressure is $P_2$. FIG. 3a shows the relationship between the quantity of intake air and EGR ratio while FIG. 3b shows the relationship between the negative intake pressure and EGR ratio with the quantity of intake air being constant. It is apparent that according to the present invention EGR ratio may be varied in response to the variations in negative intake air. In both FIGS. 3a and 3b, EGR ratio is measured based upon EGR ratio of the prior art EGR system as unity.

In summary, according to the present invention, the characteristics such as the ratio of the area of the diaphragm 10 to that of the diaphragm 9 of the pressure comparator means 20 are suitably selected and the pressure signals A and B created by the first and second converter means 29 and 48, respectively, are selected as the set points so as to control the pressure in the pressure chamber 4 automatically. The pressure in the pressure chamber 4 may be varied over a wide range from the pressure equal to the exhaust gas pressure to the pressure a few times the venturi pressure so that EGR ratio may be varied over a wide range from zero in response to the negative intake pressure. Furthermore the present invention may be equally applied to any existing prior art EGR systems with small modifications so that an optimum EGR ratio may be obtained.

According to the present invention, the pressure in the pressure chamber 4 is converted into the pressure signal which is proportional to the venturi negative pressure which is stable, and the pressure in the pressure chamber may be decreased a few times the venturi negative pressure. As a result, even with low exhaust gas pressures, the exhaust gases may be forced to flow through the fixed restriction 1 into the pressure chamber 4 against the resistance exhibited by the EGR pipe 2 so that the quantity of EGR may be accurately metered and the tolerances of the resistances exhibited by the fixed restriction 1 and the EGR pipe 2 may be somewhat relaxed. The EGR system in accordance with the present invention is highly reliable and dependable in operation and is very inexpensive to manufacture.

What is claimed is:

1. An exhaust gas recirculation system for an internal combustion engine comprising (a) exhaust gas recirculation means for recirculating the exhaust gases from an exhaust pipe to an intake pipe, said means including a fixed restriction, a pressure chamber and a pressure control valve means having a pressure control valve arranged in the order named, (b) first amplification means for amplifying the negative pressure created in a venturi in a carburetor in response to the quantity such as the negative pressure in said intake pipe which represents the variations in load on said engine, (c) second amplification means for amplifying said venturi negative pressure in response to the quantity such as the negative pressure in said intake pipe which represents the variations in load on said engine, (d) comparator means for receiving the output pressures from said first and second amplification means and the pressure in said pressure chamber so as to produce the combined pressure of said output pressures which is in proportion to said venturi negative pressure and to compare said combined pressure with said pressure from said pressure chamber, and (e) control means which cooperates with said comparator means so as to control said pressure control valve, thereby establishing the equilibrium between said combined pressure and said pressure in said pressure chamber.

2. An exhaust gas recirculation system as set forth in claim 1 wherein said first amplification means is communicated through a fixed restriction and a first pipe line with said venturi and is also communicated through a variable restriction and a second pipe line with the surrounding atmosphere; and the degree of opening of said variable restriction is adapted to be controlled in response to said quantity such as the negative pressure in said intake pipe which represents the variations in load on said engine, whereby the pressure in said first pipe line may be varied over a range extending from the atmospheric pressure to said venturi negative pressure.

3. An exhaust gas recirculation system as set forth in claim 1 wherein said second amplification means is communicated through a fixed restriction and a first pipe line with said venturi and is also communicated through a variable restriction and a second pipe line with the surrounding atmosphere; and the degree of opening of said variable restriction is adapted to be controlled in response to said quantity such as the negative pressure in said intake pipe which repesents the variations in load on said engine, whereby the pressure in said first pipe line may be varied over a range extending from said venturi negative pressure to the atmospheric pressure.

4. An exhaust gas recirculation system as set forth in claims 1, 2 or 3 wherein said comparator means includes a casing a first and second diaphragms, said casing and said first and second diaphragms define an upper diaphragm chamber above said first diaphragm, an intermediate diaphragm chamber between said first and second diaphragms and a lower diaphragm chamber below said second diaphragm, the output pressure from said first amplification means being transmitted into said upper diaphragm chamber, the output pressure from said second amplification means being transmitted into said intermediate diaphragm chamber, the pressure in said pressure chamber in said exhaust gas recirculation passage being transmitted into said lower diaphragm chamber; and a rod which is securely connected to both said first and second diaphragms and the upper end of which serves as a valve body of a pilot valve which controls the pressure of a fluid which in turn controls said pressure control valve.

5. An exhaust gas recirculation system as set forth in claim 2 wherein said first amplification means is provided with a diaphragm on one side of which is formed a diaphragm chamber into which is transmitted the pressure such as the negative pressure in said intake pipe which represents the variations in load on said engine; and said variable restriction is operatively connected to said diaphragm.

6. An exhaust gas recirculation system as set forth in claim 3 wherein said second amplification means is provided with a diaphragm on one side of which is formed a diaphragm chamber into which is transmitted the pressure such as the negative pressure in said intake pipe which represents the variations in load on said engine; and said variable restriction is operatively connected to said diaphragm.

7. An exhaust gas recirculation system as set forth in claim 1 wherein said first and second amplification means are provided with a common diaphragm on one side of which is formed a diaphragm chamber into which is transmitted the pressure such as the negative pressure in said intake pipe which represents the variations in load on said engine, a first variable restriction means through which the pressure in a first pipe line, through which is transmitted said venturi negative pressure through a first fixed restriction means, is communicated with the surrounding atmosphere, and a second variable restriction means through which the pressure in a second pipe line, through which is transmitted said venturi negaive pressure through a second fixed restriction means, is communicated with the surrounding atmosphere; and said first and second variable restriction means are operatively connected to said common diaphragm, whereby the pressure in said first pipe line may be varied from the atmospheric pressure to said venturi negative pressure while the pressure in or the interior of said second pipe line may be varied from said venturi negative pressure to the atmospheric pressure.

8. An exhaust gas recirculation system as set forth in claim 4 wherein said pressure control valve means includes a diaphragm for controlling said pressure control valve on one side of which diaphragm a diaphragm chamber which in turn is communicated with a pressure source through a pipe line means and a fixed restriction means located in said pipe line means;

said pipe line means is communicated through a branch pipe line with the surrounding atmosphere between said diaphragm chamber and said fixed restriction means; and said upper end of said rod of said comparator means is adapted to selectively open or close said branch pipe line.

9. An exhaust gas recirculation system as set forth in claim 4 wherein the area of said second diaphragm of said comparator means which is interposed between said intermediate diaphragm chamber and said lower diaphragm chamber is smaller than the area of said first diaphragm which is interposed between said upper diaphragm chamber and said intermediate diaphragm chamber.

10. An exhaust gas recirculation system as set forth in claim 8 wherein said pressure source is the negative pressure in said intake pipe.

* * * * *